US010863773B2

(12) United States Patent
Suzuki et al.

(10) Patent No.: US 10,863,773 B2
(45) Date of Patent: Dec. 15, 2020

(54) NON-BURNING TYPE FLAVOR INHALER AND ATOMIZING UNIT CALCULATING THE AMOUNT OF AEROSOL CONSUMED

(71) Applicant: JAPAN TOBACCO INC., Tokyo (JP)

(72) Inventors: Akihiko Suzuki, Tokyo (JP); Tatsuaki Iriya, Tokyo (JP); Takuma Nakano, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 243 days.

(21) Appl. No.: 15/941,417

(22) Filed: Mar. 30, 2018

(65) Prior Publication Data

US 2018/0220711 A1 Aug. 9, 2018

Related U.S. Application Data

(63) Continuation of application No. PCT/JP2016/078295, filed on Sep. 26, 2016.

(30) Foreign Application Priority Data

Sep. 30, 2015 (WO) ..... PCT/JP2015/077887

(51) Int. Cl.
*A24F 13/00* (2006.01)
*A24F 17/00* (2006.01)
(Continued)

(52) U.S. Cl.
CPC ..... *A24F 47/008* (2013.01); *A24F 47/00* (2013.01); *H05B 3/44* (2013.01)

(58) Field of Classification Search
CPC ..... A24F 47/008; A24F 47/00
(Continued)

(56) References Cited

U.S. PATENT DOCUMENTS 4,922,901 A * 5/1990 Brooks ..... A24F 47/006 128/202.27
4,947,874 A * 8/1990 Brooks ..... A24F 47/008 131/329
(Continued)

FOREIGN PATENT DOCUMENTS

CN 103997921 A 8/2014
CN 104114049 A 10/2014
(Continued)

OTHER PUBLICATIONS

Extended European Search Report, dated Aug. 23, 2019, for European Application No. 16851457.8.
(Continued)

*Primary Examiner* — Abdullah A Riyami
*Assistant Examiner* — Thang H Nguyen
(74) *Attorney, Agent, or Firm* — Birch, Stewart, Kolasch & Birch LLP

(57) ABSTRACT

This non-combustion type flavor inhaler is provided with an atomization unit having an aerosol source and a resistive heating element for atomizing the aerosol source with resistive heat, and a control unit which controls the amount of power supplied to the resistive heating element, wherein the amount of power supplied to the resistive heating element during the action of a single puff is represented by E, characteristic parameters of the atomization unit are represented by a and b, the amount of the aerosol source consumed with one puff action is represented by L, and the control unit calculates L with the formula L=aE+b, or, controls E in accordance with the formula E=(L−b)/a.

26 Claims, 7 Drawing Sheets

(51) Int. Cl.
*A24F 25/00* (2006.01)
*A24F 47/00* (2020.01)
*H05B 3/44* (2006.01)

(58) Field of Classification Search
USPC ..... 131/329
See application file for complete search history.

(56) References Cited

U.S. PATENT DOCUMENTS

| | | | | |
|---|---|---|---|---|
| 4,947,875 | A * | 8/1990 | Brooks | A24F 47/006 128/202.21 |
| 5,666,977 | A | 9/1997 | Higgins et al. | |
| 8,714,150 | B2 | 5/2014 | Alelov | |
| 8,910,640 | B2 * | 12/2014 | Sears | A24F 47/008 131/273 |
| 9,763,476 | B2 | 9/2017 | Flick | |
| 2009/0272379 | A1 * | 11/2009 | Thorens | H05B 3/00 128/202.21 |
| 2014/0020693 | A1 | 1/2014 | Cochand et al. | |
| 2014/0334804 | A1 | 11/2014 | Choi | |
| 2014/0345633 | A1 * | 11/2014 | Talon | A61M 15/06 131/329 |
| 2015/0058541 | A1 | 3/2015 | Sears et al. | |
| 2016/0205998 | A1 | 7/2016 | Matsumoto et al. | |

FOREIGN PATENT DOCUMENTS

| | | | |
|---|---|---|---|
| EP | 2113178 | A1 | 11/2009 |
| EP | 2856893 | A1 | 4/2015 |
| JP | 2014-501105 | A | 1/2014 |
| JP | 2014-501107 | A | 1/2014 |
| WO | WO 2015/046386 | A1 | 4/2015 |
| WO | WO 2015/049046 | A2 | 4/2015 |

OTHER PUBLICATIONS

International Search Report, issued in PCT/JP2016/078295, dated Dec. 20, 2015.
Canadian Office Action, dated Mar. 26, 2019, for Canadian Application No. 3,000,319.
Eurasian Office Action, dated Jul. 30, 2019, for Eurasian Application No. 201890837, along with an English translation.
Chinese Office Action and Search Report, dated Jan. 13, 2020, for Chinese Application No. 201680057079.9, along with an English translation.

* cited by examiner

NON-BURNING TYPE FLAVOR INHALER AND ATOMIZING UNIT CALCULATING THE AMOUNT OF AEROSOL CONSUMED

CROSS REFERENCE TO RELATED APPLICATIONS

This application is a Continuation of PCT International Application No. PCT/JP2016/078295, filed on Sep. 26, 2016, which claims priority under 35 U.S.C. 119(a) to Patent Application No. PCT/JP2015/077887, filed in Japan on Sep. 30, 2015, all of which are hereby expressly incorporated by reference into the present application.

TECHNICAL FIELD

The present invention relates to a non-burning type flavor inhaler including a resistance heating element configured to atomize an aerosol source by resistance electric heating, and also relates to an atomizing unit.

BACKGROUND ART

Conventionally, a non-burning type flavor inhaler for inhaling flavor without burning has been known. The non-burning type flavor inhaler includes a heater configured to atomize an aerosol source without burning (for example, Patent Literature 1). In such a non-burning type flavor inhaler, proposed is a technique for always monitoring a temperature of a heater and estimating an amount of the aerosol source consumed during a puff action, based on a relation between the temperature of a heater and a vaporization rate of the aerosol source (for example, Patent Literature 2).

CITATION LIST

Patent Literature

Patent Literature 1: WO 2015/049046 A
Patent Literature 2: JP 2014-501107 W

SUMMARY

A first feature is summarized as a non-burning type flavor inhaler comprising: an atomizing unit having an aerosol source and a resistance heating element configured to atomize the aerosol source by resistance electric heating; and a controller configured to control a power amount supplied to the resistance heating element, wherein a power amount supplied to the resistance heating element during one puff action is expressed by E, a specific parameter of the atomizing unit is expressed by a and b, an amount of the aerosol source consumed during one puff action is expressed by L, and the controller is configured to calculate the L according to an equation of $L=aE+b$, or configured to control the E according to an equation of $E=(L-b)/a$.

A second feature according to the first feature is summarized as that the non-burning type flavor inhaler comprising: an information source including the specific parameter or identification information associated with the specific parameter, wherein the controller is configured to calculate the L, based on information included in the information source.

A third feature according to the second feature is summarized as that the non-burning type flavor inhaler comprising: a control unit including the controller, wherein the atomizing unit includes the information source, in addition to the aerosol source and the resistance heating element.

A fourth feature according to any one of the first to third features is summarized as that the atomizing unit includes a holding member configured to hold the aerosol source, in addition to the aerosol source and the resistance heating element, A fifth feature according to any one of the first to fourth features is summarized as that a temperature coefficient $\alpha$ of a resistance value of the resistance heating element is $0.8\times10^{-3}$ [° C.$^{-1}$] or less.

A sixth feature according to any one of the first to fourth features is summarized as that a temperature coefficient $\alpha$ of a resistance value of the resistance heating element is $0.4\times10^{-3}$ [° C.$^{-1}$] or less.

A seventh feature according to any one of the first to sixth features is summarized as the non-burning type flavor inhaler comprising: a battery configured to accumulate power supplied to the resistance heating element, wherein an output voltage value of the battery is expressed by $V_A$, a reference voltage value of the battery is expressed by $V_C$, a correction term of the E is expressed by D, and the controller is configured to calculate the D based on the $V_A$ and the $V_C$, and is configured to calculate the E based on the D or configured to control the E based on the D.

An eighth feature according to the seventh feature is summarized as that the controller is configured to calculate the D according to an equation of $D=V_C^2/V_A^2$.

A ninth feature according to the seventh feature or the eighth feature is summarized as that the controller is configured to control the power amount supplied to the resistance heating element, according to a power amount corrected based on the D.

A tenth feature according to any one of the first to ninth features is summarized as the non-burning type flavor inhaler comprising: an information source including a resistance value of the resistance heating element or identification information associated with the resistance value of the resistance heating element, wherein the controller is configured to calculate the E, based on the information included in the information source.

An eleventh feature according to any one of the first to tenth features is summarized as the non-burning type flavor inhaler comprising: a battery configured to accumulate power supplied to the resistance heating element, wherein an output voltage value of the battery is expressed by $V_A$, a time during which a voltage is applied to the resistance heating element is expressed by T, a resistance value of the resistance heating element is expressed by R, and the controller is configured to calculate the E or configured to control the E, according to an equation of $E=VA^2/R\times T$.

A twelfth feature according to the eleventh feature is summarized as that the controller uses a predetermined value $T_0$ as T, if controlling the E.

A thirteenth feature according to any one of the first to twelfth features is summarized as that the L includes a designated $L_A$ and an actual $L_B$, and the controller is configured to first control the E according to an equation of an equation of $E=(L_A-b)/a$, and then calculate the $L_B$ according to an equation of $L_B=aE+b$.

A fourteenth feature according to any one of the first to twelfth features is summarized as that an upper limit threshold value of the power amount supplied to the resistance heating element during one puff action is expressed by $E_{MAX}$, and the controller is configured to control the power amount supplied to the resistance heating element so that the E does not exceed the $E_{MAX}$.

A fifteenth feature according to any one of the first to fourteenth features is summarized as that a lower limit threshold value of the power amount supplied to the resistance heating element during one puff action is expressed by $E_{MIN}$, and the controller is configured to calculate the L according to an equation of $L=aE_{MIN}+b$, if the E is the $E_{MIN}$ or less.

A sixteenth feature according to the fourteenth feature is summarized as the non-burning type flavor inhaler comprising: an information source including the specific parameter or identification information associated with the specific parameter, wherein the specific parameter includes information for specifying the $E_{MAX}$.

A seventeenth feature according to the fourteenth feature is summarized as the non-burning type flavor inhaler comprising: an information source including the specific parameter or identification information associated with the specific parameter, wherein the specific parameter includes information for specifying the $E_{MIN}$.

An eighteenth feature according to any one of the first to seventeenth features is summarized as that the controller is configured to estimate a remaining amount of the aerosol source, based on the L.

A nineteenth feature according to the eighteenth feature is summarized as the non-burning type flavor inhaler comprising: an information source including remaining amount information indicating the remaining amount of the aerosol source or identification information associated with the remaining amount information.

A twentieth feature according to the eighteenth feature or the nineteenth feature is summarized as that if the remaining amount of the aerosol source falls below a threshold value, the controller is configured to prohibit power supply to the resistance heating element or configured to notify a user that the remaining amount of the aerosol source falls below the threshold value.

A twenty-first feature according to the twentieth feature is summarized as that if the remaining amount information cannot be acquired, the controller is configured to prohibit the power supply to the resistance heating element or configured to notify a user that the remaining amount information cannot be acquired.

A twenty-second feature is summarized as a non-burning type flavor inhaler comprising: an atomizing unit having an aerosol source and a resistance heating element configured to atomize the aerosol source by resistance electric heating; and a controller configured to control a power amount supplied to the resistance heating element, wherein a power amount supplied to the resistance heating element during one puff action is expressed by E, a specific parameter of the atomizing unit is expressed by a and b, an amount of the aerosol source consumed during one puff action is expressed by L, and the controller is configured to calculate the L according to an equation of $L=aE+b$.

A twenty-third feature is summarized as a non-burning type flavor inhaler comprising: an atomizing unit having an aerosol source and a resistance heating element configured to atomize the aerosol source by resistance electric heating; and a controller configured to control a power amount supplied to the resistance heating element, wherein a power amount supplied to the resistance heating element during one puff action is expressed by E, a specific parameter of the atomizing unit is expressed by a and b, an amount of the aerosol source consumed during one puff action is expressed by L, and the controller is configured to control the E according to an equation of $E=(L-b)/a$.

A twenty-fourth feature is summarized as an atomizing unit comprising: an aerosol source; a resistance heating element configured to atomize the aerosol source by resistance electric heating; and an information source including a specific parameter of a unit including the aerosol source and the resistance heating element or identification information associated with the specific parameter, wherein a power amount supplied to the resistance heating element during one puff action is expressed by E, the specific parameter is expressed by a and b, an amount of the aerosol source consumed during one puff action is expressed by L, and the L is calculated according to an equation of $L=aE+b$, or the E is controlled according to an equation of $E=(L-b)/a$.

A twenty-fifth feature is summarized as an atomizing unit, comprising: an aerosol source; a resistance heating element configured to atomize the aerosol source by resistance electric heating; and an information source including a specific parameter of a unit including the aerosol source and the resistance heating element or identification information associated with the specific parameter, wherein a power amount supplied to the resistance heating element during one puff action is expressed by E, the specific parameter is expressed by a and b, an amount of the aerosol source consumed during one puff action is expressed by L, and the L is calculated according to an equation of $L=aE+b$.

A twenty-sixth feature is summarized as an atomizing unit, comprising: an aerosol source; a resistance heating element configured to atomize the aerosol source by resistance electric heating; and an information source including a specific parameter of a unit including the aerosol source and the resistance heating element or identification information associated with the specific parameter, wherein a power amount supplied to the resistance heating element during one puff action is expressed by E, the specific parameter is expressed by a and b, an amount of the aerosol source consumed during one puff action is expressed by L, and the E is controlled according to an equation of $E=(L-b)/a$.

DESCRIPTION OF EMBODIMENTS

Figure 1:
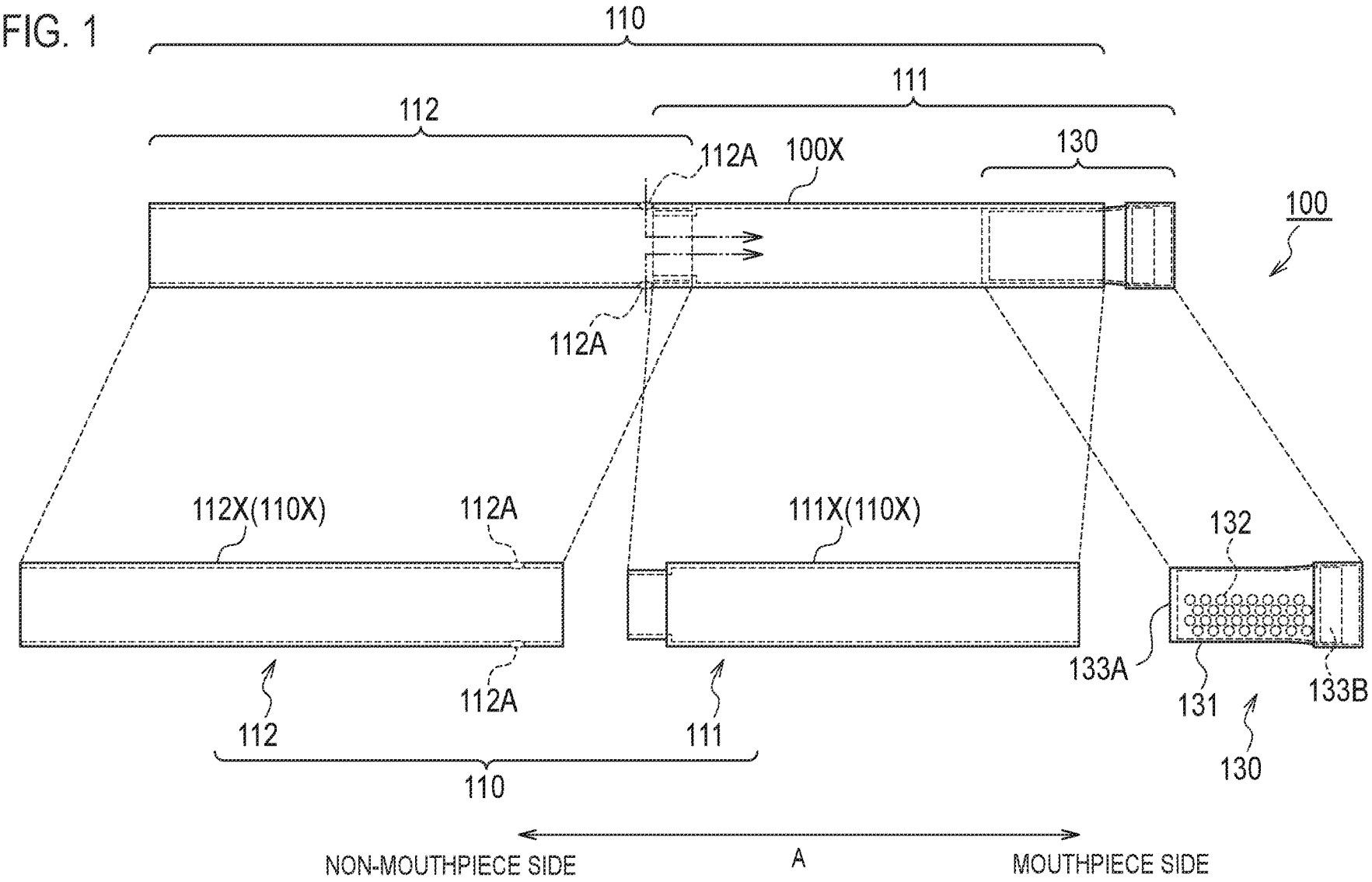
FIG. 1 is a diagram illustrating a non-burning type flavor inhaler 100 according to an embodiment.

Hereinafter, embodiments of the present invention will be described. In the following description of the drawings, the same or similar parts are denoted by the same or similar reference numerals. It is noted that the drawings are schematic, and the ratios of dimensions and the like may be different from the actual ones.

Therefore, specific dimensions and the like should be determined by referring to the following description. Of course, the drawings may include the parts with different dimensions and ratios.

Overview of Disclosure

In the technology described in Patent Literature 1, it is necessary always to monitor the temperature of the heater to estimate the amount of the aerosol source consumed by a puff action. The temperature of the heater can be detected by using a temperature sensor or calculated by using a resistor provided separately from the heater. However, an additional component for monitoring the temperature of the heater is necessary, and thus, an increase in cost and size of the non-burning type flavor inhaler ensues.

A non-burning type flavor inhaler according to the overview of the disclosure comprises: an atomizing unit having an aerosol source and a resistance heating element configured to atomize the aerosol source by resistance electric heating; and a controller configured to control a power amount supplied to the resistance heating element, wherein a power amount supplied to the resistance heating element during one puff action is expressed by E, a specific parameter of the atomizing unit is expressed by a and b, an amount of the aerosol source consumed during one puff action is expressed by L, and the controller is configured to calculate the L according to an equation of $L=aE+b$.

In the overview of disclosure, the controller calculates L according to an equation of $L=aE+b$, where E denotes the power amount supplied to the resistance heating element during one puff action, a and b denote specific parameters of the atomizing unit, and L denotes an amount of the aerosol source consumed during one puff action. With such a configuration, it is also possible to estimate an amount of the aerosol source consumed during a puff action while an increase in cost and size of the non-burning type flavor inhaler being suppressed. It should be noted that as a result of extensive studies, the inventors and others discovered that E and L have a linear relationship and such a linear relationship differs for each atomizing unit.

Embodiment (Non-Combustion Type Flavor Inhaler)

Figure 2:
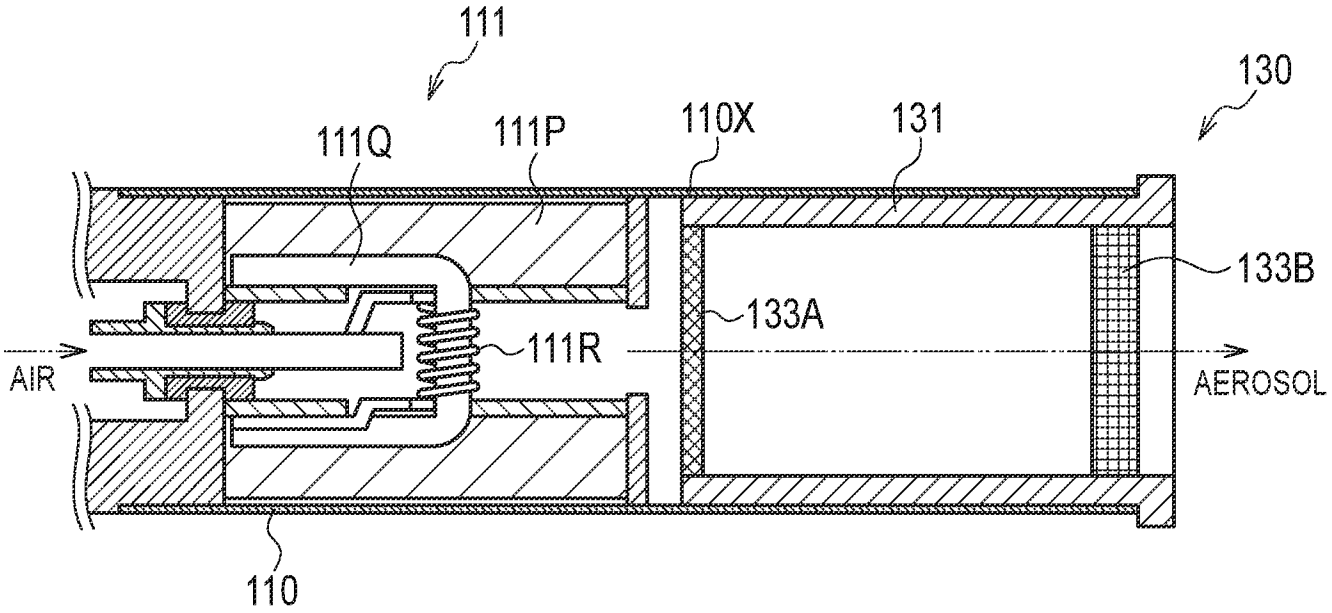
FIG. 2 is a diagram illustrating an atomizing unit 111 according to the embodiment.

Hereinafter, a non-combustion type flavor inhaler according to an embodiment will be described. FIG. 1 is a diagram illustrating a non-combustion type flavor inhaler 100 according to the embodiment. The non-combustion type flavor inhaler 100 is an instrument configured to suck a flavor component without combustion, and has a shape extending in a predetermined direction A which is a direction from a non-mouthpiece end to a mouthpiece end. FIG. 2 is a diagram illustrating an atomizing unit 111 according to the embodiment. In the following description, it should be noted that the non-combustion type flavor inhaler 100 is simply referred to as a flavor inhaler 100.

As illustrated in FIG. 1, the flavor inhaler 100 includes an inhaler main body 110 and a cartridge 130.

The inhaler main body 110 forms the main body of the flavor inhaler 100, and has a shape connectable to the cartridge 130. Specifically, the inhaler main body 110 has a tubular body 110X, and the cartridge 130 is connected to the mouthpiece end of the tubular body 110X. The inhaler main body 110 includes the atomizing unit 111 which atomizes an aerosol source without combustion and an electrical unit 112.

In the embodiment, the atomizing unit 111 includes a tubular body 111X that forms a part of the tubular body 110X. As illustrated in FIG. 2, the atomizing unit 111 includes a reservoir 111P, a wick 111Q, and a resistance heating element 111R. The reservoir 111P, the wick 111Q, and the resistance heating element 111R are housed in the tubular body 111X. The reservoir 111P stores the aerosol source. For example, the reservoir 111P is a porous body made of a material such as a resin web. The wick 111Q is an example of a holding member that holds the aerosol source supplied from the reservoir 111P. For example, the wick 111Q is made of glass fibers. The resistance heating element 111R atomizes the aerosol source sucked up by the wick 111Q. The resistance heating element 111R is configured using, for example, a resistive heating element (for example, a heating wire) wound around the wick 111Q at a predetermined pitch.

In the embodiment, the resistance heating element 111R is a resistance heating element configured to atomize the aerosol source by resistance electric heating. The amount of change in the resistance value of the resistance heating element 111R with respect to the temperature of the resistance heating element 111R is expressed by $R(T)=R_0[1+\alpha(Temp-Temp_0)]$. Here, R (T) is a resistance value at a temperature Temp, $R_0$ is a resistance value at a temperature $Temp_0$, and a is a temperature coefficient. The temperature coefficient $\alpha$ varies depending on the temperature Temp, but can be approximately a constant under manufacturing and using conditions of the flavor inhaler 100 according to the embodiment. In such a case, it is preferable that the temperature coefficient $\alpha$ of the resistance value of the resistance heating element 111R be a value that allows a change in the resistance value between a measurement temperature and a use temperature to fall within a predetermined range. The measurement temperature is a temperature of the resistance heating element 111R at the time of measuring the resistance value of the resistance heating element 1118 in manufacturing the flavor inhaler 100. The measurement temperature is preferably lower than the use temperature of the resistance heating element 111R. Further, the measurement temperature is preferably a normal temperature (in a range of 20° C.±15° C.). The use temperature is a temperature of the resistance heating element 111R at the time of using the flavor inhaler 100 and is in a range of 100° C. to 400° C. When a predetermined range is set to 20% under a condition that the measurement temperature is 20° C. and the use temperature is 250° C., any temperature coefficient $\alpha$ can be set, and the coefficient is, but not limited to, preferably $0.8\times10^{-3}$ [° C.$^{-1}$] or less, for example. When the predetermined range is set to 10% under the condition that the measurement temperature is 20° C. and the use temperature is 250° C., the temperature coefficient $\alpha$ is preferably $0.4\times10^{-3}$ [° C.$^{-1}$] or less, for example. The temperature coefficient $\alpha$ is strongly affected by a composition of the resistance heating element. In the embodiment, it is preferable to use a resistance heater including at least one of nickel, chromium, iron, platinum, and tungsten. Further, the resistance heater is preferably an alloy. The temperature coefficient $\alpha$ can be changed by adjusting the content ratio of elements contained in the alloy. By searching materials and designing with the above point of view, a substance having a different temperature coefficient $\alpha$ can be obtained. The embodiment uses a resistance heater that is made of an alloy (nichrome) of nickel and chromium, and has a temperature coefficient $\alpha$ of $0.4\times10^{-3}$ [° C.$^{-1}$] or less.

The aerosol source is a liquid such as glycerin or propylene glycol. The aerosol source is held, for example, by the porous body made of the material such as the resin web as described above. The porous body may be made of a non-tobacco material or may be made of a tobacco material. Incidentally, the aerosol source may include a flavor source containing a nicotine component or the like. Alternatively, the aerosol source does not necessarily include the flavor source containing the nicotine component or the like. The aerosol source may include a flavor source containing components other than the nicotine component. Alternatively, the aerosol source does not necessarily include the flavor source containing components other than the nicotine component.

The electrical unit 112 has a tubular body 112X that forms a part of the tubular body 110X. The electrical unit 112 includes a battery accumulating power to drive the flavor inhaler 100 and a control circuit to control the flavor inhaler 100. The battery and the control circuit are housed in the tubular body 112X. The battery is, for example, a lithium-ion battery. The control circuit is configured of, for example, a CPU and a memory. Details of the control circuit will be described later (see FIG. 3).

In the embodiment, the electrical unit 112 includes a vent hole 112A. As illustrated in FIG. 2, air introduced from the vent hole 112A is guided to the atomizing unit 111 (the resistance heating element 111R).

The cartridge 130 is configured to be connectable to the inhaler main body 110 forming the flavor inhaler 100. The cartridge 130 is provided to be closer to the mouthpiece side than the atomizing unit 111 on a flow path of a gas (hereinafter, air) sucked from the mouthpiece. In other words, the cartridge 130 is not necessarily provided to be closer to the mouthpiece side than the atomizing unit 111 in terms of a physical space, but may be provided to be closer to the mouthpiece side than the atomizing unit 111 on an aerosol flow path guiding the aerosol generated from the atomizing unit 111 to the mouthpiece side.

Specifically, the cartridge 130 includes a cartridge main body 131, a flavor source 132, a mesh 133A, and a filter 133B.

The cartridge main body 131 has a tubular shape extending in the predetermined direction A. The cartridge main body 131 houses the flavor source 132.

The flavor source 132 is provided to be closer to the mouthpiece side than the atomizing unit 111 on the flow path of the air sucked from the mouthpiece. The flavor source 132 gives the flavor component to the aerosol generated from the aerosol source. In other words, the flavor imparted to the aerosol by the flavor source 132 is conveyed to the mouthpiece.

In the embodiment, the flavor source 132 is configured using a raw material piece that gives the flavor component to the aerosol generated from the atomizing unit 111. The size of the raw material piece is preferably 0.2 mm or more and 1.2 mm or less. Further, the size of the raw material piece is preferably 0.2 mm or more and 0.7 mm or less. As the size of the raw material piece forming the flavor source 132 decreases, its specific surface area increases, and therefore the flavor component is easily released from the raw material pieces forming the flavor source 132. Accordingly, it is possible to suppress the amount of the raw material piece when giving a desired amount of the flavoring component to the aerosol. A shredded tobacco or a molded body obtained by molding a tobacco raw material into a granular shape can be used as the raw material piece forming the flavor source 132. However, the flavor source 132 may be a molded body obtained by molding the tobacco raw material into a sheet shape. Further, the raw material piece forming the flavor source 132 may be made of plants (for example, mint, herbs, or the like) other than the tobacco. A flavor such as menthol may be given to the flavor source 132.

Here, the raw material piece forming the flavor source 132 is obtained by sieving according to JIS Z 8815, for example, using a stainless sieve according to JIS Z 8801. For example, raw material pieces are sieved for 20 minutes by a dry type mechanical shaking method using a stainless sieve having a mesh size of 0.71 mm, thereby obtaining raw material pieces passing through the stainless sieve having the mesh size of 0.71 mm. Subsequently, the raw material pieces are sieved for 20 minutes by the dry type mechanical shaking method using a stainless steel sieve having a mesh size of 0.212 mm, thereby removing raw material pieces passing through the stainless sieve having the mesh size of 0.212 mm. That is, the raw material piece forming the flavor source 132 is the raw material piece which passes through the stainless sieve (mesh size=0.71 mm) defining an upper limit and does not pass through the stainless sieve (mesh size=0.212 mm) defining a lower limit. Accordingly, the lower limit of the size of the raw material piece forming the flavor source 132 is defined by the mesh size of the stainless sieve defining the lower limit in the embodiment. Incidentally, an upper limit of the size of the raw material piece forming the flavor source 132 is defined by the mesh size of the stainless sieve defining the upper limit.

In the embodiment, the flavor source 132 is a tobacco source. The tobacco source may be a one including a basic substance. In such a case, pH of an aqueous solution including the tobacco source and water of 10 times weight ratio is preferably greater than 7, and more preferably 8 or more. Accordingly, it is possible to efficiently take out the flavor component generated from the tobacco source by the aerosol. Accordingly, it is possible to suppress the amount of the tobacco source when giving the desired amount of the flavoring component to the aerosol. On the other hand, the pH of the aqueous solution including the tobacco source and water of 10 times weight ratio is preferably 14 or less, and more preferably 10 or less. Accordingly, it is possible to suppress damage (such as corrosion) to the flavor inhaler 100 (for example, the cartridge 130 or the inhaler main body 110).

It should be noted that the flavor component generated from the flavor source 132 is conveyed by the aerosol, and it is unnecessary to heat the flavor source 132 itself.

The mesh 133A is provided so as to close an opening of the cartridge main body 131 on the non-mouthpiece side with respect to the flavor source 132, and the filter 133B is provided so as to close an opening of the cartridge main body 131 on the mouthpiece side with respect to the flavor source 132. The mesh 133A has a roughness of a degree that prevents passage of the raw material piece forming the flavor source 132. The roughness of the mesh 133A has a mesh size of, for example, 0.077 mm or more and 0.198 mm or less. The filter 133B is made of a substance having air permeability. The filter 133B is preferably an acetate filter, for example. The filter 133B has a roughness of a degree that prevents passage of the raw material piece forming the flavor source 132.

(Block Configuration)

Figure 3:
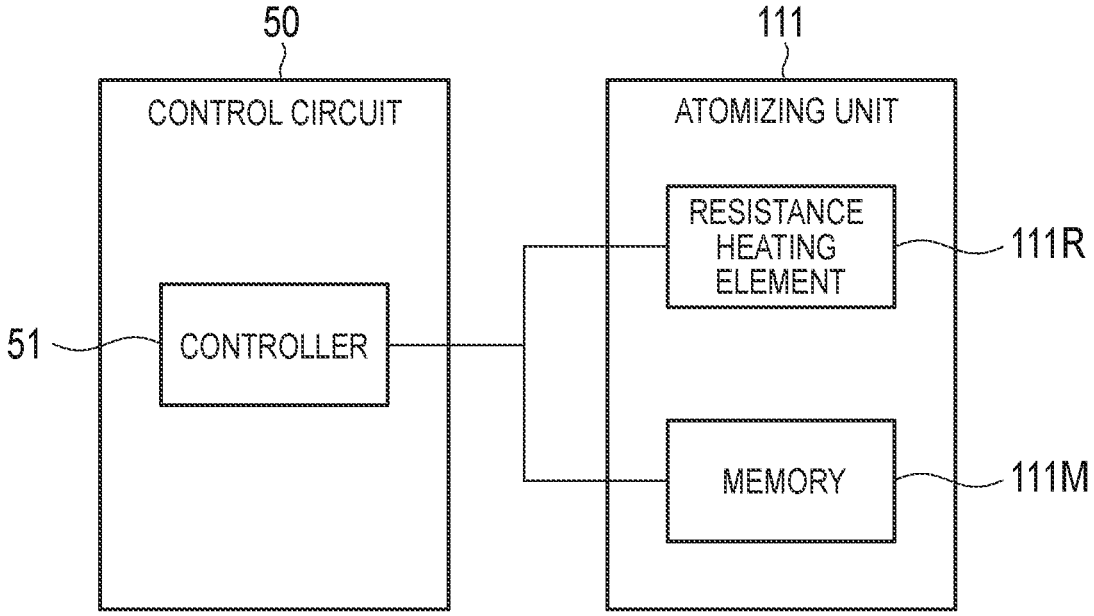
FIG. 3 is a diagram illustrating a block configuration of the non-burning type flavor inhaler 100 according to the embodiment.

Hereinafter, a block configuration of the non-combustion type flavor inhaler according to the embodiment will be described. FIG. 3 is a diagram illustrating the block configuration of the non-combustion type flavor inhaler 100 according to the embodiment.

As illustrated in FIG. 3, the above-described atomizing unit 111 includes a memory 111M in addition to the resistance heating element 111R, etc. The control circuit 50 provided in the electrical unit 112 described above includes a controller 51. The control circuit 50 is an example of a control unit which includes a controller configured to control a power amount supplied to the resistance heating element 111R.

The memory 111M is an example of an information source which has a specific parameter of the atomizing unit 111 (the wick 111Q, the resistance heating element 111R, etc.) or identification information associated with the specific parameter. In the embodiment, the memory 111M stores the specific parameter of the atomizing unit 111.

The memory 111M may store the resistance value of the resistance heating element 111R or identification information associated with the resistance value of the resistance heating element 111R. In the embodiment, the memory 111M stores the resistance value of the resistance heating element 111R.

The memory 111M may store remaining amount information indicating the remaining amount of the aerosol source retained in the reservoir 111P or identification information associated with the remaining amount information. In the embodiment, the memory 111M stores the remaining amount information.

Here, the resistance value of the resistance heating element 111R may be an actually measured value of the resistance value or an estimated value of the resistance value. Specifically, when the resistance value of the resistance heating element 111R is measured by connecting terminals of a measurement device to both ends of the resistance heating element 111R, it is possible to use the actually measured value as the resistance value of the resistance heating element 111R. Alternatively, it is necessary to consider a resistance value of a part (such as an electrode) other than the resistance heating element 111R when the resistance value of the resistance heating element 111R is measured by connecting a terminal of a measurement device to an electrode connected to the resistance heating element 111R in a state where the electrode for connection with the power source provided in the flavor inhaler 100 is connected to the resistance heating element 111R. In such a case, it is preferable to use an estimated value in consideration of the resistance value of the part (such as the electrode) other than the resistance heating element 111R as the resistance value of the resistance heating element 111R.

Further, a magnitude of the power amount supplied to the resistance heating element 111R is defined by a value of a voltage to be applied to the resistance heating element 111R and a time during which the voltage is applied to the resistance heating element 111R. For example, in a case where the voltage is continuously applied to the resistance heating element 111R, the magnitude of the power amount supplied to the resistance heating element 111R is changed depending on a change in the value of the voltage to be applied to the resistance heating element 111R. On the other hand, in a case (pulse control) where the voltage is intermittently applied to the resistance heating element 111R, the magnitude of the power amount supplied to the resistance heating element 111R is changed depending on a change in the value of the voltage to be applied to the resistance heating element 111R or a duty ratio (that is, a pulse width and a pulse interval).

The controller 51 controls the power amount supplied to the resistance heating element 111R. Here, the controller 51 calculates, according to an equation of $L=aE+b$, the amount of the aerosol source consumed during one puff action.

E: the power amount supplied to the resistance heating element 111R during one puff action a, b: specific parameters of the atomizing unit 111

L: the amount of the aerosol source consumed during one puff action

Figure 4:
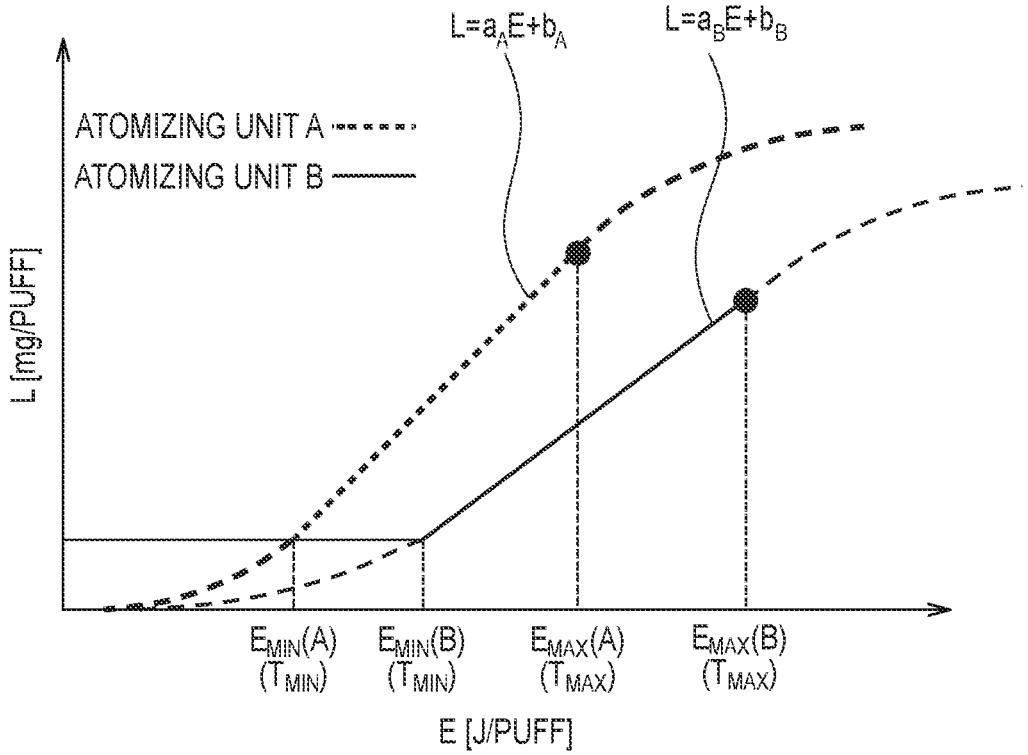
FIG. 4 is a graph for describing a linear relationship of L and E according to the embodiment.

In particular, as shown in FIG. 4, as a result of extensive studies, the inventors and others discovered that E and L have a linear relationship and such a linear relationship differs for each atomizing unit 111. In FIG. 4, a vertical axis is L [mg/puff], and a horizontal axis is E [J/puff]. For example, as for an atomizing unit A, E and L have the linear relationship if E is within the range from $E_{MIN}$ (A) to $E_{MAX}$ (A), and specific parameters of the atomizing unit A are $a_A$ and $b_A$. Meanwhile, as for an atomizing unit B, E and L have the linear relationship if E is within the range from $E_{MIN}$ (B) to $E_{MAX}$ (B), and specific parameters of the atomizing unit B are $a_B$ and $b_B$.

As above, at least, the parameters a, b that define the linear relationship between E and L differ for each atomizing unit 111, and thus, are specific parameters of the atomizing unit 111. Further, parameters $E_{MIN}$ and $E_{MAX}$ that define a range in which E and L have the linear relationship also differ for each atomizing unit 111, and thus, can be considered as specific parameters of the atomizing unit 111.

Here, the specific parameters of the atomizing unit 111 depend on a composition of the wick 111Q, a composition of the resistance heating element 111R, a composition of the aerosol source, a structure of the atomizing unit 111 (the wick 111Q and the resistance heating element 111R), and the like. Therefore, it should be noted that the specific parameters differ for each atomizing unit 111.

Note that, the above-described memory 111M may store, in addition to the parameters a, b, the parameters $E_{MIN}$ and $E_{MAX}$ or identification information associated with these specific parameters. However, E is affected by a voltage $V_S$ to be applied to the resistance heating element 111R and an application time T of the voltage $V_S$, and thus, $E_{MIN}$ and $E_{MAX}$ may be specified by the voltage $V_S$, $T_{MIN}$, and $T_{MAX}$. That is, the above-described memory 111M may store, in addition to the parameters a, b, the parameters voltage $V_S$, $T_{MIN}$, and $T_{MAX}$ or identification information associated with these specific parameters. Note that, the voltage Vs is a parameter used for replacing $E_{MIN}$ and $E_{MAX}$ with $T_{MIN}$ and $T_{MAX}$, and may be a constant value. If the voltage $V_S$ is a constant value, the voltage $V_S$ may not need to be stored in the memory 111M. In the embodiment, the voltage $V_S$ corresponds to a reference voltage value $V_C$ described later, and the memory 111M stores the parameters $T_{MIN}$ and $T_{MAX}$.

The controller 51 may control the power amount supplied to the resistance heating element 111R so that E (T) does not exceed $E_{MAX}$ ($T_{MAX}$). Specifically, for example, if the power amount (application time) reaches $E_{MAX}$ ($T_{MAX}$), the controller 51 ends the power supply to the resistance heating element 111R. Therefore, if E reaches $E_{MAX}$, the controller 51 may calculate, according to an equation of $L=aE_{MAX}+b$, the amount of the aerosol source consumed during one puff action. On the other hand, if E (T) is $E_{MIN}$ ($T_{MIN}$) or below, the controller 51 may calculate, according to an equation of $L=aE_{MIN}+b$, the amount of the aerosol source consumed during one puff action. In such a case, if E is within the range from $E_{MIN}$ to $E_{MAX}$, the controller 51 may calculate, according to the equation of $L=aE+b$, the amount of the aerosol source consumed during one puff action.

In the embodiment, the controller 51 estimates, based on L, the remaining amount (mg) of the aerosol source. Specifically, the controller 51 calculates L (mg) for each puff action, subtracts L from the remaining amount of the aerosol source indicated by the remaining amount information stored in the memory 111M, and updates the remaining amount information stored in the memory 111M.

If the remaining amount of the aerosol source falls below a threshold value, the controller 51 may prohibit the power supply to the resistance heating element 111R or may notify a user that the remaining amount of the aerosol source falls below the threshold value. If not possible to acquire the remaining amount information, the controller 51 may prohibit the power supply to the resistance heating element 111R or may notify the user that the remaining amount information cannot be acquired. The notification to the user may be performed by light emission of a light-emitting element provided in the flavor inhaler 100, for example.

In the embodiment, the controller 51 may calculate E according to an equation of $E=E_A=V_A^2/R\times T$.

$E_A$: the power amount in a case where $V_A$ is applied to the resistance heating element 111R $V_A$: the output voltage value of a battery T: time during which voltage is applied to the resistance heating element 111R R: a resistance value of the resistance heating element 111R Note that, $V_A$ and T are values detectable by the controller 51, and R is a value acquirable by the controller 51 as a result of reading out from the memory 111M. Note that, R may be estimated by the controller 51.

Here, the controller 51 preferably corrects the above-described E, based on a correction term D. D is calculated based on the output voltage value $V_A$ of the battery and the reference voltage value $V_C$ of the battery. $V_C$ is a value predetermined depending on a type, etc. of the battery, and is a voltage higher than at least a final voltage of the battery. If the battery is a lithium-ion battery, the reference voltage value $V_C$ can be 3.2 V, for example. In a case where a level of the power amount supplied to the resistance heating element 111R can be set in a plurality of levels, that is, in a case where the flavor inhaler 100 has a plurality of modes having different amount of aerosol generated during one puff action, a plurality of reference voltage values $V_C$ may be set.

Figure 5:
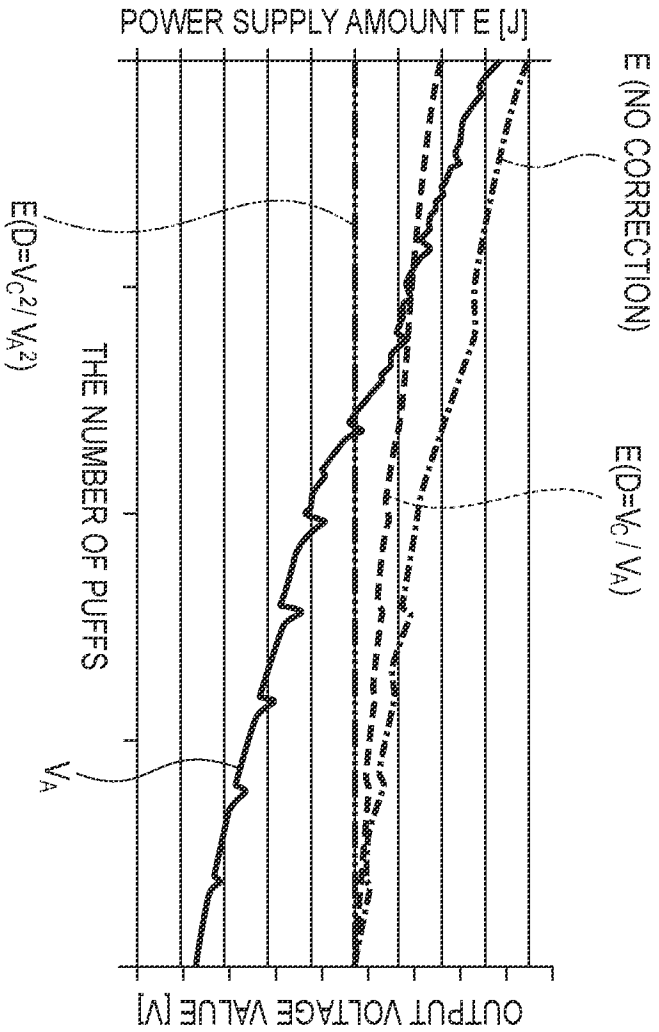
FIG. 5 is a graph for describing a correction term D of E according to the embodiment.

In particular, as shown in FIG. 5, the output voltage value $V_A$ of the battery decreases along with an increase in the number of times of puff actions (hereinafter, the number of puffs). Therefore, upon E not being corrected by D, even if the voltage application time T is assumed to be constant, E also decreases along with the increase in the number of puffs. As a result, the amount (L) of the aerosol source consumed during one puff action changes.

To solve the above-described problem, the controller 51 calculates the correction term D according to an equation of $D=V_C/V_A$. Preferably, the controller 51 calculates the correction term D according to an equation of $D=V_C^2/V_A^2$. The controller 51 calculates E according to an equation of $E=D\times E_A$. In other words, the controller 51 may calculate E according to an equation of $E=D\times V_A^2/R\times T$. Note that, $E_A$ is a power amount supplied to the resistance heating element 111R in a case where a correction using D is not performed, and is a power amount in a case where the voltage $V_A$ is not corrected and applied to the resistance heating element 111R.

The above-described description states that E is corrected by D in the estimation of the remaining amount of the aerosol source; however, the controller 51 may control the power amount supplied to the resistance heating element 111R, based on the power amount corrected based on D (that is, $D\times E_A$) Note that, D used for correcting the power amount supplied to the resistance heating element 111R is same as D used for correcting E that is calculated for estimating the remaining amount of the aerosol source.

Here, a method of correcting E by using D may include correcting the voltage to be applied to the resistance heating element 111R (for example, $D\times V_A$) or correcting the duty ratio (that is, the pulse width and the pulse interval) (for example, D×T). Note that, the correcting the voltage to be applied to the resistance heating element 111R is achieved by using a DC/DC converter. The DC/DC converter may be a step-down converter or a step-up converter.

(Control Method)

Figure 6:
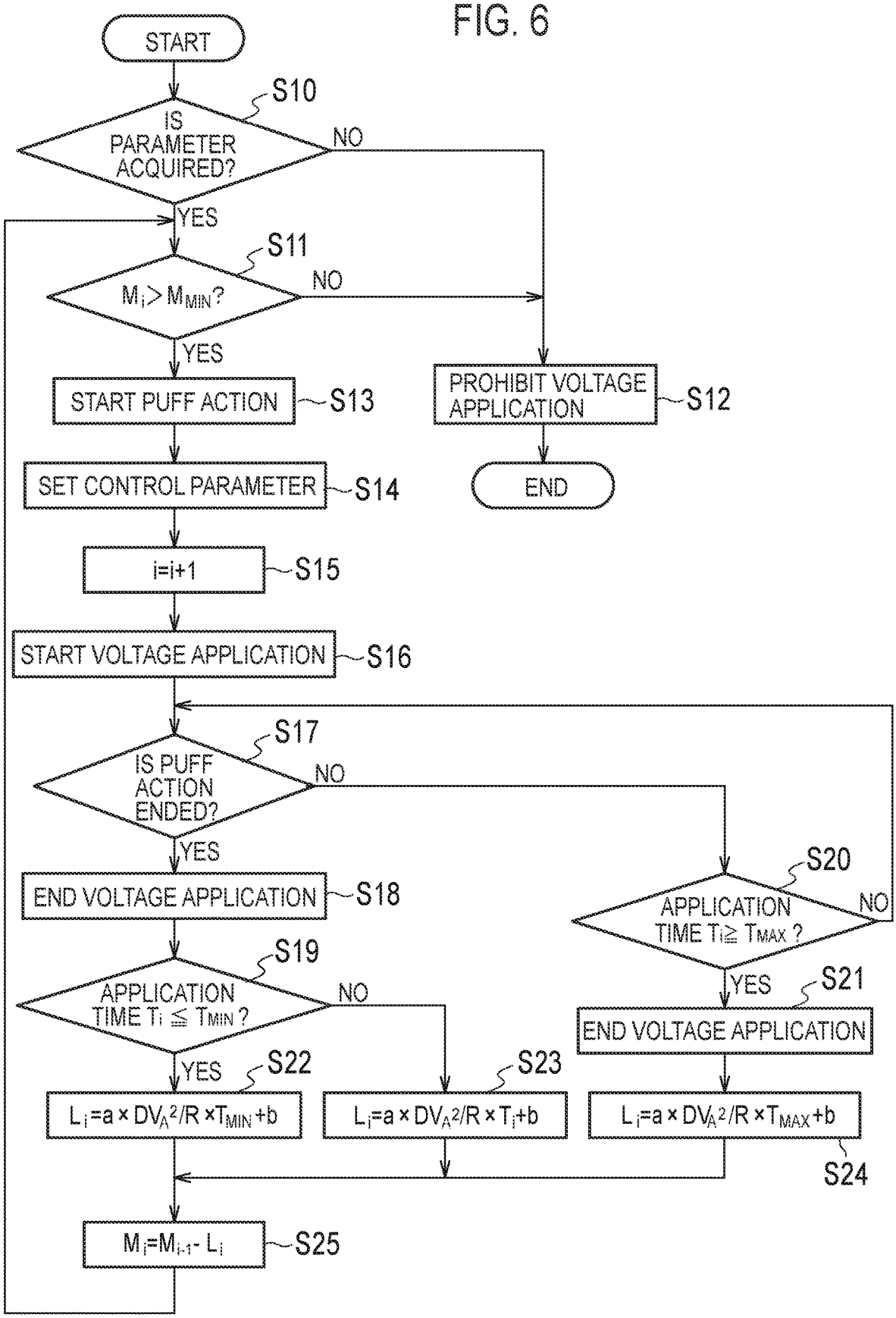
FIG. 6 is a diagram for describing a control method according to the embodiment.

A control method according to the embodiment will be described below. FIG. 6 is a flow diagram for describing the control method according to the embodiment. A flow illustrated in FIG. 6 is started by a connection of the atomizing unit 111 to the electrical unit 112, for example.

As illustrated in FIG. 6, in step S10, the controller 51 determines whether or not various types of parameters have been acquired from the memory 111M. The various types of parameters include: specific parameters (a, b, $T_{MIN}$, $T_{MAX}$) of the atomizing unit 111; the resistance value (R) of the resistance heating element 111R; and the remaining amount information indicating the remaining amount ($M_i$) of the aerosol source. If the determination result is YES, the controller 51 performs a process of step S11. If the determination result is NO, the controller 51 performs a process of step S12.

In step S11, the controller 51 determines whether or not the remaining amount ($M_i$) of the aerosol source is larger than a minimum remaining amount ($M_{MIN}$). The minimum remaining amount ($M_{MIN}$) is a threshold value for determining whether or not the aerosol source consumed during one puff action remains. If the determination result is YES, the controller 51 performs a process of step S13. If the determination result is NO, the controller 51 performs the process of step S12.

In step S12, the controller 51 prohibits the power supply to the resistance heating element 111R. The controller 51 may notify a user that the remaining amount of the aerosol source falls below the threshold value, or may notify the user that the remaining amount information cannot be acquired.

In step S13, the controller 51 detects a start of a puff action. The start of the puff action can be detected by using an inhalation sensor, for example.

In step S14, the controller 51 sets a control parameter for controlling the power amount supplied to the resistance heating element 111R. Specifically, the controller 51 sets a correction term D for correcting the power amount supplied to the resistance heating element 111R. As described above, D may be used for the correction of the voltage to be applied to the resistance heating element 111R, or may be used for the correction of the duty ratio (that is, the pulse width and the pulse interval). In step S14, the controller 51 may set the voltage corrected based on D, or may set the duty ratio corrected based on D. Further, the controller 51 may set the voltage and duty ratio corrected based on D. D is preferably $V_C^2/V_A^2$. Note that, the process of step S14 may be performed before starting voltage application (step S16) to the resistance heating element 111R. Further, the output voltage value $V_A$ of the battery may be acquired at the same timing as step S14, or before step S14. The output voltage value $V_A$ of the battery is preferably acquired after step S13.

In step S15, the controller 51 increments a counter (i) of the number of puffs.

In step S16, the controller 51 starts the voltage application to the resistance heating element 111R.

In step S17, the controller 51 determines whether or not the puff action has ended. The end of the puff action can be detected by using the inhalation sensor, for example. If the determination result is YES, the controller 51 performs a process of step S18. If the determination result is NO, the controller 51 performs a process of step S20.

In step S18, the controller 51 ends the voltage application to the resistance heating element 111R.

In step S19, the controller 51 determines whether or not a time Ti during which the voltage is applied to the resistance heating element 111R is $T_{MIN}$ or below. If the determination result is YES, the controller 51 performs a process of step S22. If the determination result is NO, the controller 51 performs a process of step S23.

In step S20, the controller 51 determines whether or not the time Ti during which the voltage is applied to the resistance heating element 111R is $T_{MAX}$ or above. If the determination result is YES, the controller 51 performs a process of step S21. If the determination result is NO, the controller 51 returns to the process of step S17.

In step S21, the controller 51 ends the voltage application to the resistance heating element 111R.

In step S22, the controller 51 calculates, according to $L_i=a\times DV_A^2/R\times T_{MIN}+b$, the amount of the aerosol source consumed during an $i^{th}$ puff action. D is preferably $V_C^2/V_A^2$.

In step S23, the controller 51 calculates, according to $L_i=a\times DV_A^2/R\times T+b$, the amount of the aerosol source consumed during the $i^{th}$ puff action. D is preferably $V_C^2/V_A^2$.

In step S24, the controller 51 calculates, according to $L_i=a\times DV_A^2/R\times T_{MAX}+b$, the amount of the aerosol source consumed during the $i^{th}$ puff action. D is preferably $V_C^2/V_A^2$.

In step S25, the controller 51 updates, according to an equation of $M_i=M_{i-1}-L_i$, the remaining amount of the aerosol source at the point when the $i^{th}$ puff action ends.

(Operation and Effect)

In the embodiment, the controller 51 calculates L according to an equation of L=aE+b, where E denotes the power amount supplied to the resistance heating element 111R during one puff action, a and b denote specific parameters of the atomizing unit 111, and L denotes the amount of the aerosol source consumed during one puff action. With such a configuration, it is also possible to estimate an amount of the aerosol source consumed during a puff action while an increase in cost and size of the non-burning type flavor inhaler being suppressed. It should be noted that as a result of extensive studies, the inventors and others discovered that E and L have a linear relationship and such a linear relationship differs depending on each atomizing unit 111.

First Modification

A first modification of the embodiment will be described below. A difference from the embodiment will be described, below.

Specifically, in the embodiment, the information stored in the memory 111M includes: specific parameters (a, b, $T_{MIN}$, $T_{MAX}$) of the atomizing unit 111; the resistance value (R) of the resistance heating element 111R; and the remaining amount information indicating the remaining amount ($M_i$) of the aerosol source. However, in the first modification, the information stored in the memory 111M is identification information associated with the above-described information.

(Block configuration)

Figure 7:
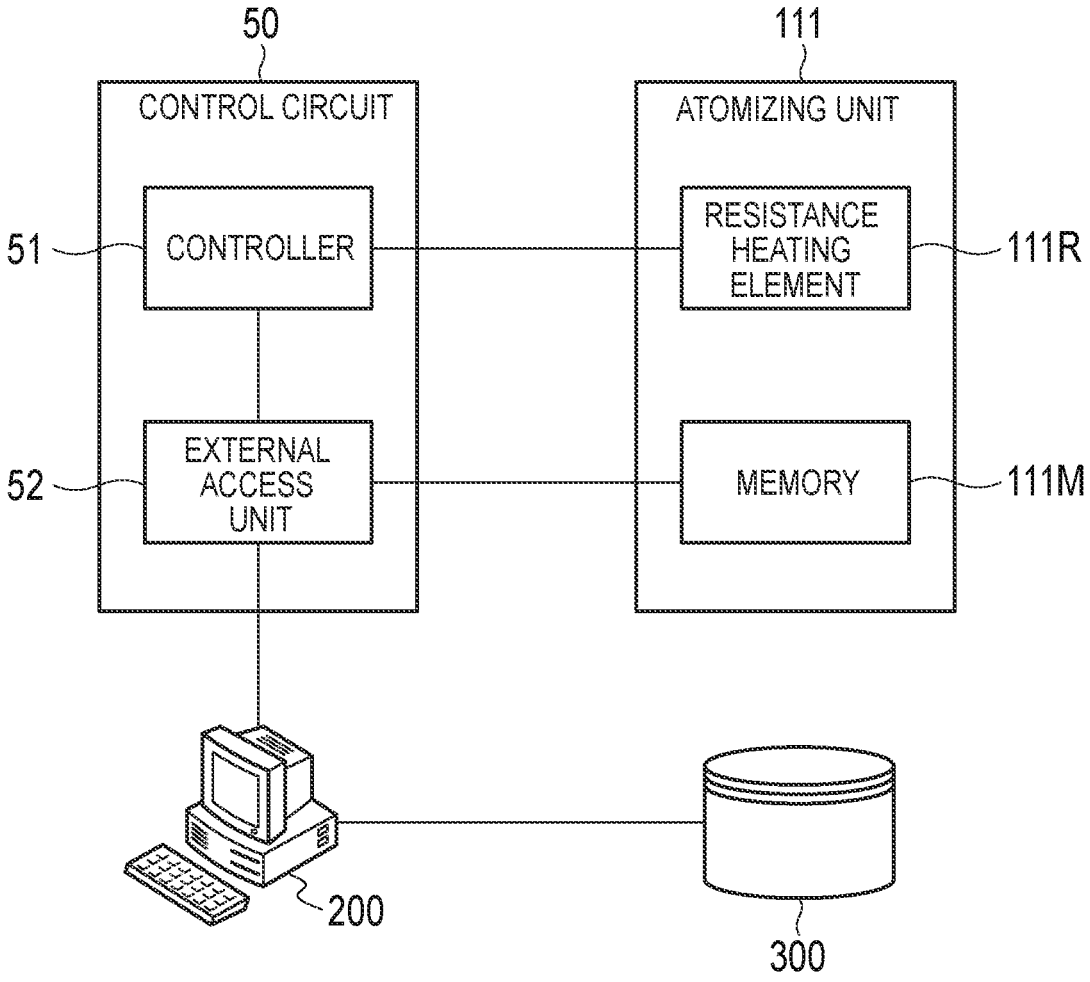
FIG. 7 is a diagram illustrating a block configuration of the non-burning type flavor inhaler 100 according to a first modification.

A block configuration of a non-burning type flavor inhaler according to the first modification will be described, below. FIG. 7 is a diagram illustrating the block configuration of the flavor inhaler 100 according to the first modification. It should be noted that in FIG. 7, same reference numerals are applied to the same configurations as that in FIG. 3.

Here, in FIG. 7, a communication terminal 200 is a terminal having a function of communicating with a server 300. The communication terminal 200 includes, for example, a personal computer, a smartphone, and a tablet. The server 300 is an example of an external storage medium configured to store specific parameters (a, b, $T_{MIN}$, $T_{MAX}$) of the atomizing unit 111, the resistance value (R) of the resistance heating element 111R, and the remaining amount information indicating the remaining amount ($M_i$) of the aerosol source. Further, as described above, the memory 111M stores the identification information associated with the above-described information.

As illustrated in FIG. 7, the control circuit 50 includes an external access unit 52. The external access unit 52 has a function of directly or indirectly accessing the server 300. FIG. 7 illustrates, as an example, a function of the external access unit 52 accessing the server 300 via the communication terminal 200. In such a case, the external access unit 52 may be a module (for example, a USB port) for establishing a wired connection with the communication terminal 200, or may be a module (for example, a Bluetooth module or an NFC (Near Field Communication) module) for establishing a wireless connection with the communication terminal 200, for example.

Note that, the external access unit 52 may have a function of directly communicating with the server 300. In such a case, the external access unit 52 may be a wireless LAN module.

The external access unit 52 reads out the identification information from the memory 111M, and uses the read-out identification information to acquire information (that is, specific parameters (a, b, $T_{MIN}$, $T_{MAX}$) of the atomizing unit 111, the resistance value (R) of the resistance heating element 111R, and the remaining amount information indicating the remaining amount ($M_i$) of the aerosol source) associated with the identification information, from the server 300.

The controller 51 controls the power supplied to the resistance heating element 111R and estimates the remaining amount of the aerosol source, based on the information (that is, specific parameters (a, b, $T_{MIN}$, $T_{MAX}$) of the atomizing unit 111, the resistance value (R) of the resistance heating element 111R, and the remaining amount information indicating the remaining amount ($M_i$) of the aerosol source) which the external access unit 52 acquires from the server 300 by using the identification information.

(Operation and Effect)

In the first modification, a similar effect to that of the embodiment can be obtained by acquiring various types of parameters by using the identification information stored in the memory 111M.

Second Modification

A second modification of the embodiment will be described, below. A difference from the first modification will be described, below.

Specifically, in the first modification, the information source including the identification information associated with various types of parameters is the memory 111M provided in the atomizing unit 111. However, in the second modification, the information source is a medium or the like provided separately from the atomizing unit 111. The medium is, for example, a paper medium indicating the identification information (such as a label attached to an outer surface of the atomizing unit 111, an instruction manual packaged together with the atomizing unit 111, and a container such as a box to house the atomizing unit 111).

Figure 8:
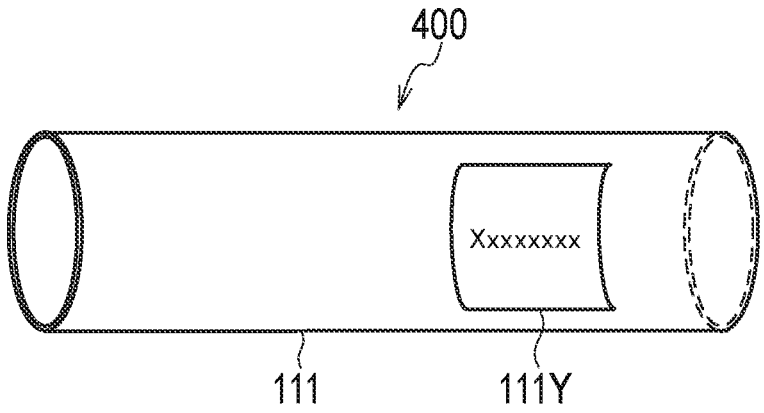
FIG. 8 is a diagram illustrating an atomizing unit package 400 according to a second modification.

In the second modification, as illustrated in FIG. 8, an atomizing unit package 400 has the atomizing unit 111 and a label 111Y attached to an outer surface of the atomizing unit 111. The label 111Y is an example of an information source having, as specific information, the identification information associated with various types of parameters.

(Block Configuration)

Figure 9:
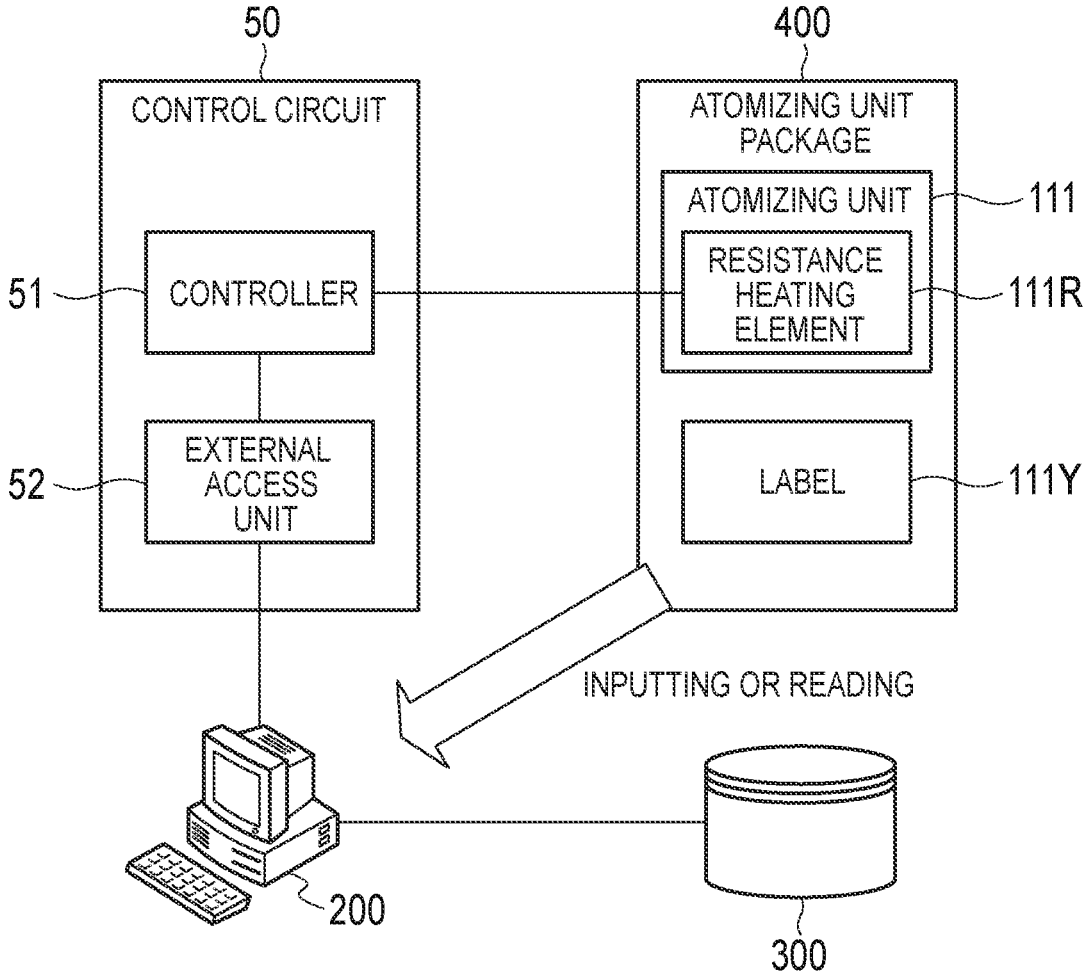
FIG. 9 is a diagram illustrating a block configuration of the non-burning type flavor inhaler 100 according to the second modification.

A block configuration of a non-burning type flavor inhaler according to the second modification will be described, below. FIG. 9 is a diagram illustrating the block configuration of the flavor inhaler 100 according to the second modification. It should be noted that in FIG. 9, same reference numerals are applied to the same configurations as that in FIG. 7.

As illustrated in FIG. 9, the communication terminal 200 acquires identification information provided in the label 111Y by inputting the identification information or reading the identification information. The communication terminal 200 acquires information (that is, specific parameters (a, b, $T_{MIN}$, $T_{MAX}$) of the atomizing unit 111, the resistance value (R) of the resistance heating element 111R, and the remaining amount information indicating the remaining amount ($M_i$) of the aerosol source) associated with the acquired identification information, from the server 300.

The external access unit 52 acquires, from the communication terminal 200, information (that is, specific parameters (a, b, $T_{MIN}$, $T_{MAX}$) of the atomizing unit 111, the resistance value (R) of the resistance heating element 111R, and the remaining amount information indicating the remaining amount ($M_i$) of the aerosol source) which the communication terminal 200 acquires from the server 300.

The controller 51 controls the power supplied to the resistance heating element 111R and estimates the remaining amount of the aerosol source, based on the information (that is, specific parameters (a, b, $T_{MIN}$, $T_{MAX}$) of the atomizing unit ill, the resistance value (R) of the resistance heating element 111R, and the remaining amount information indicating the remaining amount ($M_i$) of the aerosol source) which the external access unit 52 acquires from the server 300 by using the identification information.

Note that, the second modification describes a case where the communication terminal 200 acquires the identification information from the label 111Y. However, the embodiment is not limited thereto. If the control circuit 50 has a function of inputting the identification information or reading the identification information, the control circuit 50 may acquire the identification information from the label 111Y.

(Operation and Effect)

In the second modification, a medium provided separately from the atomizing unit 111 is used for the information source including the identification information associated with various types of parameters. Therefore, even if the memory 111M is not mounted on the atomizing unit 111, a similar effect to that of the embodiment can be obtained.

Third Modification

A third modification of the embodiment will be described, below. A difference from the embodiment will be described, below.

The embodiment describes, as an example, a case where the equation of L=aE+b is used for estimating the remaining amount of the aerosol source. However, the third modification describes, as an example, a case where the equation of L=aE+b (that is, E=(L−b)/a) is used for controlling the power amount supplied to the resistance heating element. That is, the power amount supplied to the resistance heating element is controlled by designating the amount of the aerosol source consumed during one puff action (in other words, the amount of aerosol generated by the atomizing unit 111 during one puff action).

It should be noted that the third modification is based on similar knowledge to that of the embodiment where, as illustrated in FIG. 4, similarly to the embodiment, E and L at least partly have a linear relationship and such a linear relationship differs for each atomizing unit.

In the third modification, the controller 51 controls E according to the equation of E=(L−b)/a, based on the above-described knowledge.

Here, the controller 51 may control E according to the equation of $E=E_A=V_A^2/R\times T$. In such a case, the controller 51 controls T so that a relation of $V_A^2/R\times T=(L-b)/a$ is satisfied. The controller 51 may control $V_A$ or may control $V_A$ and T so that the relation of $V_A^2/R\times T=(L-b)/a$ is satisfied.

Note that, in an aspect where E is controlled by designating L, T is a parameter affected by the length of the puff action, and thus, a predetermined value $T_0$ is used as the above-described T. The predetermined value $T_0$ is predetermined by assuming the standard length of puff action though it is not limited especially. The predetermined value $T_0$ may be, for example, from 1 second to 4 seconds, and preferably be from 1.5 seconds to 3 seconds.

The standard length of puff action can be derived from statistics of the length of puff actions of users, and is any value between a lower limit value of the lengths of puff actions by a plurality of users and an upper limit value of the lengths of puff actions by the plurality of users. The lower limit value and the upper limit value, for example, may be derived as the upper limit value and the lower limit value of a 95% confidence interval of an average value and may be derived as $m\pm n\sigma$ (here, m is an average value, σ is a standard deviation, and n is a positive real number), based on distribution of data of the lengths of puff actions of the users. For example, in a case where the lengths of puff actions of the users can be considered to follow a normal distribution where the average value m is 2.4 seconds and the standard deviation σ is 1 second, the upper limit value of the standard length of puff action can be derived as $m+n\sigma$, as described above, and is about three to four seconds.

T is controlled by the duty ratio, for example. The control of T may stop the power supply to the resistance heating element 111R if the power amount supplied to the resistance heating element 111R reaches E calculated according to the equation of E=(L−b)/a.

In the third modification, as described above, the amount L of the aerosol source consumed during one puff action is designated. A method of designating L may be, but not limited to, the following methods. For example, the flavor inhaler 100 may include a user interface for designating L, and L may be designated by using the user interface. The user interface may be a dial, and L may be designated by an operation (rotation) of the dial. The user interface may be a button, and L may be designated by an operation (depression) of the button. The user interface may be a touch panel, and L may be designated by an operation (touch) of the touch panel. Alternatively, the flavor inhaler 100 may have a communication function, and L may be designated by an external device by using the communication function. The external device may be a smartphone, a tablet terminal, and a personal computer. In such cases, the flavor inhaler 100 may include a member (a display or an LED) configured to display information representing the designated L. The information representing the designated L may be represented by an absolute value (XX mg) of the amount of aerosol of K-time puff actions generated when an M-second puff action is performed K times at an interval of N seconds, may be represented by an absolute value (XX mg) of the amount of aerosol in one puff action generated when an M-second puff action is performed once, or may be represented by a relative value (a level such as large, medium, and small) of the amount of the aerosol. The above-described predetermined value $T_0$ can be used for the above-described M seconds.

Further, the controller 51 may control E based on the correction term D. Similarly to the embodiment, the controller 51 calculates the correction term D according to the equation of $D=V_C/V_A$. Preferably, the controller 51 calculates the correction term D according to the equation of $D=V_C^2/V_A^2$. In such a case, the controller 51 controls E by controlling any one or more parameters of $V_A$ and T. However, it should be noted that the controller 51 controls any one or more parameters of $V_A$ and T so that the relation of $V_A^2/R\times T=(L-b)/a$ is satisfied.

Here, a method of controlling E by using D may include correcting the voltage to be applied to the resistance heating element 111R (for example, $D\times V_A$) or correcting the duty ratio (that is, the pulse width and the pulse interval) (for example, $D\times T$). Note that, the correcting the voltage to be applied to the resistance heating element 111R is achieved by using the DC/DC converter. The DC/DC converter may be a step-down converter or a step-up converter.

In such control of the power amount, the controller 51 may control the power amount (E) supplied to the resistance heating element 111R so that E expressed by (L−b)/a does not exceed $E_{MAX}$. Note that, similarly to the embodiment, $E_{MIN}$ and $E_{MAX}$ may be specified by the voltage $V_S$, $T_{MIN}$, and $T_{MAX}$.

For a specific timing at which a method of controlling E is decided, step S14 illustrated in FIG. 6 can be considered, for example. In step S14, the controller 51 decides a method of controlling E (that is, any one or more parameters of $V_A$ and T) so that the relation of E=(L−b)/a is satisfied. Note that, similarly to the embodiment, the process of step S14 may be performed before starting the voltage application (step S16) to the resistance heating element 111R. Further, the output voltage value $V_A$ of the battery may be acquired at the same timing as step S14, or before step S14. The output voltage value $V_A$ of the battery is preferably acquired after step S13.

L may be designated in advance. L may be designated for each atomizing unit 111. L may be optionally designated by a user. The method of designating L may be the method using the user interface or may be the method using the communication function, as described above. A timing of designating L should be a timing at which the puff action is not performed (that is, a timing before the puff action is started). The timing of designating L may be between puff actions. The timing of designating L may be before the start of an initial puff action after the atomizing unit 111 is connected to the electrical unit 112. Alternatively, the timing of designating L may be before the start of an initial puff action after the flavor inhaler 100 is powered on. Alternatively, the timing of designating L may be before the start of a next puff action when a puff action is not performed over a certain period of time after the puff action ends. A timing of acquiring the designated L is not especially limited, but the designated L may be acquired in step S10 or acquired in step S14.

In the third modification, L is the amount of the aerosol source consumed during one puff action; however, the third modification is not limited thereto. L may be expressed by the amount of an inhaling flavor component imparted to the aerosol during one puff action. In such a case, if the amount of the inhaling flavor component is expressed by Q, it is assumed that there is a function f satisfying Q=f (L).

For example, as illustrated in FIG. 1, in a case where a flavor source is arranged, separately from the aerosol source, at a downstream side of the atomizing unit 111, Q and L can be considered to have a relation of a proportional function, and thus, Q can be estimated based on L.

Alternatively, in a case where the aerosol source includes a flavor source, the relation between L and Q can be expressed based on the concentration of the flavor source included in the aerosol source, and thus, Q can be estimated based on L. Note that, a function representing the relation between L and Q may be specified by actually measuring the concentration of the inhaling flavor component included in the aerosol. Such a specification is performed in the manufacturing stage of the atomizing unit 111, for example.

In the third modification, a case can be considered where a value of L consumed during an actual puff action differs from a designated value of L. For example, in a case where E is controlled by using the above-described predetermined value $T_0$, a case can be considered where the length of the actual puff action is shorter than the length of the puff action to be referenced when determining the predetermined value $T_0$. That is, as for the above-described L, it can be considered that there exist two types of $L_S$: a designated $L_A$ and an actual $L_B$. In such a case, the controller 51 may first control E according to an equation of $E=(L_A-b)/a$, and then, similarly to the embodiment, calculate (estimate) $L_B$ that is the actually consumed amount of the aerosol source according to an equation of $L_B=aE+b$.

(Operation and Effect)

In third modification, the controller 51 controls E according to the equation of E=(L−b)/a where E denotes the power amount supplied to the resistance heating element 111R during one puff action, a and b denote specific parameters of the atomizing unit 111, and L denotes the amount of the aerosol source consumed during one puff action. With such a configuration, E is appropriately and simply controlled, and then L designated by a user, for example, can be supplied.

In the third modification, the user can intuitively easily grasp the amount of aerosol (the amount of the inhaling flavor component) generated by the atomizing unit 111 during one puff action, as a result of controlling E by designating L rather than controlling E by directly designating E.

Other Embodiments

The present invention is explained through the above-described embodiments, but it must not be understood that this invention is limited by the statements and the drawings constituting a part of this disclosure. From this disclosure, various alternative embodiments, examples, and operational technologies will become apparent to those skilled in the art.

In the embodiment, the cartridge 130 does not include the atomizing unit 111; however, the embodiment is not limited thereto. For example, the cartridge 130 and the atomizing unit 111 may be configured as one unit.

Although not particularly mentioned in the embodiment, the atomizing unit 111 may be configured to be connectable to the inhaler main unit 110.

In the embodiment, the memory 111M stores various types of parameters (the specific parameters (a, b, $T_{MIN}$, $T_{MAX}$) of the atomizing unit 111, the resistance value (R) of the resistance heating element 111R, and the remaining amount information indicating the remaining amount ($M_i$) of the aerosol source). However, the embodiment is not limited thereto. The memory 111M may store only a part of various types of parameters and may store identification information associated with the remaining parameters. The remaining parameters may be acquired by a similar method to that in the first and second modifications.

In the embodiment, the flow illustrated in FIG. 6 is started by a connection of the atomizing unit 111 to the electrical unit 112. However, the embodiment is not limited thereto. The flow illustrated in FIG. 6 may be started by an access to the communication terminal 200 or the server 300 (see the first modification).

In the embodiment, the start and the end of a puff action are detected by using the inhalation sensor. However, the embodiment is not limited thereto. For example, the power supply to the resistance heating element 111R may be performed by an operation of a push button, and in such a case, the start and the end of the puff action are detected based on whether the pushbutton is operated.

In the first and second modifications, if not possible to acquire various types of parameters associated with the identification information, the controller 51 may prohibit the power supply to the resistance heating element 111R or may notify the user that the remaining amount information cannot be acquired.

Although not particularly mentioned in the embodiment, the above-described embodiments are useful even in a case where the temperature coefficient $\alpha$ of the resistance value of the resistance heating element is a large value (for example, a value larger than 0.8). In such a case, for example, the resistance value of the resistance heating element 111R at the use temperature should be obtained by applying the temperature coefficient $\alpha$ to the resistance value of the resistance heating element 111R measured in manufacturing the flavor inhaler 100, and the resistance value of the resistance heating element 111R at the use temperature should be stored in the memory 111M. Alternatively, the resistance value of the resistance heating element 111R associated with the identification information stored in the memory 111M should be the resistance value of the resistance heating element 111R at the use temperature. In such a configuration, when the controller 51 calculates E according to the equation of $E=E_A=V_A^2/R\times T$, the resistance value of the resistance heating element 111R at the use temperature is used as a resistance value R.

In the embodiment, the flavor inhaler 100 of a type which heats a liquid aerosol source is described as an example. However, the embodiment is not limited thereto. The embodiment may be applied to a flavor inhaler of a type which heats an aerosol source with which a holding member (smoking article) constituted of tobacco materials is impregnated (for example, an article described in US Patent Application Publication No. 2014/0348495 A1 or European Patent No. 2814341). The state of the aerosol source held in the holding member is not limited to a liquid state, but may be a gel or solid state. That is, the flavor inhaler 100 may have a configuration for heating the aerosol source, and the aerosol source in any state is available.

INDUSTRIAL APPLICABILITY

According to the embodiment, it is possible to provide a non-burning type flavor inhaler and an atomizing unit which is possible to estimate an amount of an aerosol source consumed during a puff action while an increase in cost and size of the non-burning type flavor inhaler being suppressed.

The invention claimed is:

1. A non-burning type flavor inhaler comprising:

an atomizing unit having an aerosol source and a resistance heating element configured to atomize the aerosol source by resistance electric heating; and a controller configured to control a power amount supplied to the resistance heating element, wherein a power amount supplied to the resistance heating element during one puff action is expressed by E, wherein an amount of the aerosol source consumed during one puff action is expressed by L, wherein the controller is configured to calculate the amount of the aerosol source consumed during one puff action according to an equation of L=aE+b, or configured to control the power amount supplied to the resistance heating element during one puff action according to an equation of E=(L−b)/a, and wherein the coefficients a and b associated with the atomizing unit are stored in a memory.

2. The non-burning type flavor inhaler according to claim 1, further comprising:

an information source providing the coefficients to the memory, wherein the controller is configured to calculate the amount of the aerosol source consumed during one puff action, based on information included in the information source.

3. The non-burning type flavor inhaler according to claim 2, comprising:

a control unit including the controller, wherein the atomizing unit further includes the information source.

4. The non-burning type flavor inhaler according to claim 1, wherein the atomizing unit further includes a holding member configured to hold the aerosol source.

5. The non-burning type flavor inhaler according to claim 1, wherein a temperature coefficient a of a resistance value of the resistance heating element is $0.8\times10^{-3}$ [° C.$^{-1}$] or less.

6. The non-burning type flavor inhaler according to claim 1, wherein a temperature coefficient a of a resistance value of the resistance heating element is $0.4\times10^{-3}$ [° C.$^{-1}$] or less.

7. The non-burning type flavor inhaler according to claim 1, comprising:

a battery configured to accumulate power supplied to the resistance heating element, wherein an output voltage value of the battery is expressed by $V_A$, wherein a reference voltage value of the battery is expressed by $V_C$, wherein a correction term of the power amount supplied to the resistance heating element during one puff action is expressed by D, and wherein the controller is configured to calculate the correction term based on the output voltage value and the reference voltage value, and is configured to calculate the power amount supplied to the resistance heating element during one puff action based on the correction term or configured to control the power amount supplied to the resistance heating element during one puff action based on the correction term.

8. The non-burning type flavor inhaler according to claim 7, wherein the controller is configured to calculate the correction term according to an equation of $D=V_C^2/V_A^2$.

9. The non-burning type flavor inhaler according to claim 7, wherein the controller is configured to control the power amount supplied to the resistance heating element, according to a power amount corrected based on the correction term.

10. The non-burning type flavor inhaler according to claim 1, comprising:

an information source including a resistance value of the resistance heating element, wherein the controller is configured to calculate the power amount supplied to the resistance heating element during one puff action based on the information included in the information source.

11. The non-burning type flavor inhaler according to claim 1, comprising:

a battery configured to accumulate power supplied to the resistance heating element, wherein an output voltage value of the battery is expressed by $V_A$, a time during which a voltage is applied to the resistance heating element is expressed by T, a resistance value of the resistance heating element is expressed by R, and the controller is configured to calculate the power amount supplied to the resistance heating element during one puff action or configured to control the power amount supplied to the resistance heating element during one puff action, according to an equation of $E=V_A^2/R\times T$.

12. The non-burning type flavor inhaler according to claim 11, wherein the controller uses a predetermined value $T_0$ as T, if controlling the power amount supplied to the resistance heating element during one puff action.

13. The non-burning type flavor inhaler according to claim 1, wherein the amount of the aerosol source consumed during one puff action includes a designated $L_A$ and an actual $L_B$, and the controller is configured to first control the power amount supplied to the resistance heating element during one puff action according to an equation of $E=(L_A-b)/a$, and then calculate the $L_B$ according to an equation of $L_B=aE+b$.

14. The non-burning type flavor inhaler according to claim 1, wherein an upper limit threshold value of the power amount supplied to the resistance heating element during one puff action is expressed by $E_{MAX}$, and the controller is configured to control the power amount supplied to the resistance heating element so that the power amount supplied to the resistance heating element during one puff action does not exceed the $E_{MAX}$.

15. The non-burning type flavor inhaler according to claim 1, wherein a lower limit threshold value of the power amount supplied to the resistance heating element during one puff action is expressed by $E_{MIN}$, and the controller is configured to calculate the amount of the aerosol source consumed during one puff action according to an equation of $L=aE_{MIN}+b$, if the power amount supplied to the resistance heating element during one puff action is the $E_{MIN}$ or less.

16. The non-burning type flavor inhaler according to claim 14, comprising:

an information source including the coefficients, wherein the coefficients are used for specifying the $E_{MAX}$.

17. The non-burning type flavor inhaler according to claim 15, comprising:

an information source including the coefficients, wherein the coefficients are used for specifying the $E_{MIN}$.

18. The non-burning type flavor inhaler according to claim 1, wherein the controller is configured to estimate a remaining amount of the aerosol source, based on the amount of the aerosol source consumed during one puff action.

19. The non-burning type flavor inhaler according to claim 18, comprising:

an information source including remaining amount information indicating the remaining amount of the aerosol source.

20. The non-burning type flavor inhaler according to claim 18, wherein if the remaining amount of the aerosol source falls below a threshold value, the controller is configured to prohibit power supply to the resistance heating element or configured to notify a user that the remaining amount of the aerosol source falls below the threshold value.

21. The non-burning type flavor inhaler according to claim 20, wherein if the remaining amount information cannot be acquired, the controller is configured to prohibit the power supply to the resistance heating element or configured to notify a user that the remaining amount information cannot be acquired.

22. A non-burning type flavor inhaler comprising:

an atomizing unit having an aerosol source and a resistance heating element configured to atomize the aerosol source by resistance electric heating; and a controller configured to control a power amount supplied to the resistance heating element, wherein a power amount supplied to the resistance heating element during one puff action is expressed by E, wherein an amount of the aerosol source consumed during one puff action is expressed by L, wherein the controller is configured to calculate the amount of the aerosol source consumed during one puff action according to an equation of $L=aE+b$, and wherein the coefficients a and b associated with the atomizing unit are stored in a memory.

23. A non-burning type flavor inhaler comprising:

an atomizing unit having an aerosol source and a resistance heating element configured to atomize the aerosol source by resistance electric heating; and a controller configured to control a power amount supplied to the resistance heating element, wherein a power amount supplied to the resistance heating element during one puff action is expressed by E, wherein an amount of the aerosol source consumed during one puff action is expressed by L, wherein the controller is configured to control the power amount supplied to the resistance heating element during one puff action according to an equation of $E=(L-b)/a$, and wherein the coefficients a and b associated with the atomizing unit are stored in a memory.

24. An atomizing unit, comprising:

an aerosol source;

a resistance heating element configured to atomize the aerosol source by resistance electric heating; and an information source including specific values associated with the aerosol source and the resistance heating element, wherein a power amount supplied to the resistance heating element during one puff action is expressed by E, wherein an amount of the aerosol source consumed during one puff action is expressed by L, wherein the amount of the aerosol source consumed during one puff action is calculated according to an equation of L=aE+b, or the power amount supplied to the resistance heating element during one puff action is controlled according to an equation of E=(L−b)/a, and wherein the specific values are the coefficients a and b.

25. An atomizing unit, comprising:

an aerosol source;

a resistance heating element configured to atomize the aerosol source by resistance electric heating; and an information source including specific values associated with the aerosol source and the resistance heating element, wherein a power amount supplied to the resistance heating element during one puff action is expressed by E, wherein an amount of the aerosol source consumed during one puff action is expressed by L, wherein the amount of the aerosol source consumed during one puff action is calculated according to an equation of L=aE+b, and wherein the specific values are the coefficients a and b.

26. An atomizing unit, comprising:

an aerosol source;

a resistance heating element configured to atomize the aerosol source by resistance electric heating; and an information source including specific values associated with the aerosol source and the resistance heating element or identification information associated with the specific values, wherein a power amount supplied to the resistance heating element during one puff action is expressed by E, wherein an amount of the aerosol source consumed during one puff action is expressed by L, wherein the power amount supplied to the resistance heating element during one puff action is controlled according to an equation of E=(L−b)/a, and wherein the specific values are the coefficients a and b.

* * * * *